United States Patent [19]

Vosbeek

[11] 4,128,423

[45] Dec. 5, 1978

[54] DIAZOTYPE MATERIAL THAT CAN BE DEVELOPED BY APPLYING A SMALL AMOUNT OF DEVELOPING LIQUID, AND DEVELOPMENT THEREOF

[75] Inventor: Gerardus J. Vosbeek, Velden, Netherlands

[73] Assignee: Océ-Nederland B.V., Venlo, Netherlands

[21] Appl. No.: 787,615

[22] Filed: Apr. 14, 1977

Related U.S. Application Data

[63] Continuation of Ser. No. 575,785, May 8, 1975, abandoned.

[30] Foreign Application Priority Data

May 29, 1974 [NL] Netherlands ..... 7407161

[51] Int. Cl.[2] ..... G03C 5/34; G03C 1/60

[52] U.S. Cl. ..... 96/49; 96/75; 96/91 R

[58] Field of Search ..... 96/49, 75, 91 R

[56] References Cited

U.S. PATENT DOCUMENTS

| | | | |
|---|---|---|---|
| 2,780,547 | 2/1957 | Ferzola et al. | 96/75 |
| 3,406,943 | 8/1969 | Welch | 96/75 |
| 3,409,434 | 11/1968 | Landberg et al. | 96/75 |
| 3,607,271 | 9/1971 | Helder et al. | 96/75 |
| 3,627,563 | 12/1971 | Bollon et al. | 96/75 |
| 3,658,538 | 4/1972 | Hilhorst | 96/75 |
| 3,756,823 | 9/1973 | Tor Haaf et al. | 96/75 |
| 4,043,816 | 8/1977 | Bomers et al. | 96/91 R |

FOREIGN PATENT DOCUMENTS

| | | | |
|---|---|---|---|
| 2325579 | 12/1973 | Fed. Rep. of Germany | 96/49 |
| 966258 | 8/1964 | United Kingdom | 96/75 |
| 1129407 | 10/1968 | United Kingdom | 96/75 |
| 1169227 | 10/1969 | United Kingdom | 96/75 |

OTHER PUBLICATIONS

Chemical Abstracts, vol. 80, 1974, #151171j.

*Primary Examiner*—Charles L. Bowers
*Attorney, Agent, or Firm*—Albert C. Johnston

[57] ABSTRACT

Diazotype material which after imagewise exposure can be developed by applying onto its sensitized surface between 1.5 and 4.5 $cm^3$ per square meter of developing solution, consists of a paper support, the same side of which is coated successively with a sealing layer containing as a filmforming binder polyvinylacetate or a copolymer of styrene with butadiene and a light-sensitive layer having a dry weight of at most 8 g per square meter and comprising a diazonium compound, polyvinyl alcohol with a degree of hydrolysis over 75% and starch particles, whereby the weight ratio polyvinyl alcohol to starch particles is 1 : 5 to 20. The light-sensitive layer may also comprise an azo-coupling component.

14 Claims, No Drawings

DIAZOTYPE MATERIAL THAT CAN BE DEVELOPED BY APPLYING A SMALL AMOUNT OF DEVELOPING LIQUID, AND DEVELOPMENT THEREOF

This is a continuation of copending application Ser. No. 575,785, filed May 8, 1975 now abandoned.

The present invention relates to diazotype material, more particularly to a one-component diazotype material that can be developed by applying a small amount of developing liquid.

Dutch Patent application No. 72 07 099 describe a process for making diazotype copies, in which one-component diazotype material is developed after image-wise exposure by spreading a buffered, aqueous solution of an azo-coupling component over the light-sensitive layer, in an amount between 1.5 and 4.5 $cm^3$ per square meter. The diazotype paper used in the process according to the patent application mentioned above consists, in a simple embodiment, of a paper support that, after a so-called precoat layer has been applied for smoothing its surface, has been sensitized in such a way that, after drying, the diazonium compound has penetrated into the precoat layer to an average depth of at most 8 micrometers. The sensitization of the material is accomplished by applying an adapted concentrated diazo-solution over the precoat layer in an amount of 2–8 $cm^3$ per square meter. Due to the fact that, upon development, only one side of the diazotype paper is wetted with developing liquid and the developing liquid penetrates through the precoat layer into the paper support, the diazotype copies will show a strong curl, in particular immediately after development. To avoid curling of the copy, the paper support may be provided with a sealing layer preventing the developing liquid from penetrating into the paper fibres. Preferably, the sealing layer is applied on either side of the paper support, because otherwise curling may occur as a consequence of water penetrating into the paper fibres of the reverse side of the copy. For instance, unless the reverse side of the diazotype paper is coated with a sealing layer, the just developed copies will curl during piling, as a consequence of moisture penetrating from the image side of one copy into the reverse side of the overlying copy.

The manufacture of non-curling or almost non-curling diazotype paper by providing either side of a paper support with a sealing layer, then coating one side with a precoat layer and, finally, sensitizing the precoat layer by applying a small amount of concentrated diazo-solution, is cumbersome and requires a complex coating machine with long drying paths, when it is desired to manufacture the material in one machining operation and at high speed. Due to the fact that the front side of the paper is subjected to three coating operations and, on the other hand, the reverse side to one operation only, it may frequently occur that the paper does not remain flat in the coating machine, in consequence of which an additional treatment of the reverse side is necessary, thus complicating the manufacture of the diazotype paper even more.

The manufacture of the diazotype paper would be considerably simplified if the light-sensitive diazonium compound as well as the further solid components of the sensitizing liquid could be applied simultaneously with the precoat over the sealing layer. However, the choice of the components for such a diazotype material is no simple matter, because a lot of demands, partly contrary to each other, must be met. For instance, the paper support must be coated with a more or less hydrophobic sealing layer on which it must be possible, without the aid of an adhesive layer, to apply a very smooth, more or less hydrophilic light-sensitive layer having sufficient adhesion both in dry and in moist condition. It should be possible to apply the components of the light-sensitive layer with sufficient adhesion to the sealing layer, using a coating liquid that contains no solvents penetrating deeply into the sealing layer, or swelling it, because the diazonium compound would otherwise be partly trapped in the sealing layer and be inaccessible to the developing liquid.

The light-sensitive layer itself may not be too thick, because the developing liquid, in order to obtain complete development of the diazotype material, must be able to penetrate through the whole thickness of the layer but, on the other hand, it must fully absorb the amount of developing liquid applied, in order to obtain copies feeling dry. Further, substances reducing the durability of the diazotype material, or the quality or durability of the diazotype copy to an unacceptable level may, of course, not be incorporated in the sealing layer and the light-sensitive layer.

The present invention provides for a diazotype material of the desired composition which meets the requirements with respect to durability and quality of the copy, and which, according to the developing process described in the Dutch Patent application No. 7207099, can be developed fast and completely, whereby copies feeling immediately dry are obtained. The diazotype material according to the invention comprises a paper support, the same side of which is coated successively with a sealing layer containing as a film-forming binder polyvinyl acetate, or a copolymer of styrene with butadiene, and a light-sensitive layer having a dry weight of at most 8 $g/m^2$ and comprising a diazonium compound, polyvinyl alcohol with a degree of hydrolysis over 75% and starch particles, whereby the weight ratio starch particles to polyvinyl alcohol is from 5–20:1. Upon development in the said process the diazotype material according to the invention produces strong copies, feeling dry to the touch almost immediately and showing no or no appreciable curl.

According to the invention the paper support is coated with a sealing layer containing as a binder polyvinyl acetate or a copolymer of styrene with butadiene. The sealing layer can be applied to the support using a solution of the film-forming binder but, preferably, it is formed by means of a dispersion of the binder in water, or in a mixture of water with one or more water-miscible organic solvents, for example alcohols, ketones, glycol, and glycol esters. To sized papers the sealing layer is preferably applied from an aqueous dispersion, whereas on well-milled papers, such as natural transparent paper, the sealing layer is often advantageously formed from a dispersion of the binder in a mixture of water and an organic solvent. The mixtures of water with organic solvent may contain up to 75% by volume of organic solvent but, in general, mixtures containing no more than 50% by volume of organic solvent are used. To form a dense coating, the dispersion layer applied is dried at increased temperature.

For the formation of the sealing layer, suitable aqueous dispersions of polyvinyl acetate and copolymers of styrene with butadiene are commercially available. If the sealing layer on the support material is formed using a polyvinyl acetate dispersion, a cross-linking agent is preferably added to the dispersion, and the polyvinyl acetate coating is cross-linked by heating it at 130°–180° C. for some time. It has appeared that this cross-linking improves the adhesive properties of the polyvinyl acetate coating for the light-sensitive layer subsequently to be applied. Moreover, the penetration of the sensitizing liquid into the polyvinyl acetate coating is reduced to a minimum. The familiar products can be used as cross-linking agent, such as paraformaldehyde, glyoxal, and water-soluble, optionally modified, condensation products of urea and malamine with formaldehyde, for example dimethylolurea, dimethylolmelamine, hexamethylolmelamine, dimethyloltetramethoxymethylmelamine and hexamethoxymethylmelamine. A very suitable cross-linking agent is hexamethoxymethylmelamine.

Paraformaldehyde and glyoxal are not preferably used, because they generally have an adverse effect on the durability of the diazotype material.

Used as cross-linking catalysts are acids or acid salts, for example hydrochloric acid, sulphuric acid, formic acid, acetic acid, benzenesulphonic acids such as p-toluene sulphonic acid, ammonium chloride, ammonium sulphate and aluminium sulphate.

In addition to the film-forming binder, the sealing layer may contain one or more fillers, in order to make it more susceptible to the sensitizing liquid to be applied, and to improve the adherence of the light-sensitive layer. The filler content may not be so high that the sealing layer becomes water-permeable. In general the weight ratio filler to binder in the sealing layer lies under 1:1 and preferably it is from 0.25–0.75:1. The familiar products can be used as fillers, such as clay, kaolin, diatomaceous earth, talcum, silica, barium sulphate, titanium dioxide, zinc oxide and aluminium oxide. A preferred filler is silica with a particle size under 10 micrometers. The use of this filler in the sealing layer proves to have a favorable effect on the complete development of the diazotype material and the brilliancy of the azo-dyestuff. The sealing layer must fully cover the paper surface. The weight of the sealing layer to be applied depends largely on the surface roughness of the paper.

For papers with a smooth surface the application of a sealing layer having a dry weight of 2–5 g per square meters will usually suffice. Papers with a rough surface require the application of a thicker layer but, in most cases, the layer need not be thicker than equivalent to a dry weight from 8 to 10 g per square meter.

Highly suitable sealing layers according to the invention are filler-free polyvinyl acetate layers applied from an aqueous dispersion, which have been cross-linked, preferably with hexamethoxymethylmelamine, as well as filler-containing layers from a copolymer of styrene with butadiene, which copolymer contains 50–75% by weight of styrene and 50–25% by weight of butadiene, whereby the weight ratio filler to binder is from 0.25–0.75:1, and the filler preferably is silica with particle size under 10 micrometers.

The sealing layer is coated with a light-sensitive layer which contains at least a light-sensitive diazonium compound and, moreover, polyvinyl alcohol and starch particles in the weight ratio of 1 to 5–20. The degree of hydrolysis of the polyvinyl alcohol must at least amount to 75% and, preferably, it amounts to at least 98%. Further, high-molecular polyvinyl alcohols are preferred to low-molecular products, because they possess a higher binding capacity. Particularly preferred are high-molecular polyvinyl alcohols with a degree of hydrolysis at at least 98%, of which a 4 percent. aqueous solution of 20° C. has a viscosity of at least 25 centipoises. The light-sensitive layer contains as a filler starch particles, whereby the weight ratio starch particles to polyvinyl alcohol is from 5–20:1. If the weight ratio starch to polyvinyl alcohol is higher than 20:1 the adherence of the light-sensitive layer to the sealing layer will be insufficient, especially in moist condition, immediately after development of the diazotype material.

If the weight ratio starch to polyvinyl alcohol is smaller than 5:1 the ability of the light-sensitive layer to absorb the developer, and the velocity with which the developer penetrates into the light-sensitive layer become too low, as a result of which the developing speed of the diazotype material decreases too much and copies that do not immediately feel dry are obtained. The starch particles may consist of wheat starch, corn starch and rice starch, e.g. Rice starch is preferably used, because this product has an intenser whiteness than other starch products, and because, thanks to a relatively low spread in particle size, smoother layers can be obtained with it.

The light-sensitive diazonium compound is selected from the diazonium compounds known for application in the diazotype process. In general, these are benzene diazonium compounds carrying, in 4-position, a tertiary amino group, a secondary acylamino group, a phenyl group or an etherified mercapto group and, in one or two of the other positions, a halogen atom, an alkyl, alkoxy, phenoxy or tertiary acylamino group or a combination of these substituents. Preferably, a diazonium compound having such a high coupling activity that the diazotype material can be developed with a neutral to weakly acid buffered phloroglucinol solution is used. Suitable actively coupling diazonium compounds are described, inter alia, in the British Patent Specification Nos. 919 037, 919 812, 1 045 242, 1 064 128 and 1 064 129, as well as in the Belgian Patent Specification Nos. 657 907, 665 368 and 661 008.

If for the development of the diazotype material an alkaline developing liquid is used, more slowly coupling diazonium compounds, for instance the diazonium compounds described in the British Patent Specification Nos. 867 630, 875 307, 888 598, 919 037; the French Patent Specification Nos. 1 269 874, 1 269 875, 1 269 876; the Belgian Patent Specification No. 574 785; the Dutch Patent application No. 69 12 554, and the German Patent application No. 2 003 508, may also be used for the sensitization of the diazotype material.

The auxiliary agents usually applied in diazotype materials such as acid stabilizers, for example citric acid, tartaric acid, boric acid, benzene and naphthalene sulphonic acid, anti-yellowing agents and developing accelerators, may be used in the light-sensitive layer.

The light-sensitive layer is applied over the sealing layer by means of an aqueous liquid, preferably containing a wetting agent. To prevent the diazonium compound from being trapped in the sealing layer no or no essential amounts of substances, for example organic solvents or swelling agents, causing strong penetration of the sensitizing liquid into the sealing layer, are incorporated in the sensitizing liquid.

The light-sensitive layer applied has a dry weight of at most 8 g per square meter, which corresponds with a layer thickness not exceeding approximately 8 micrometers. Preferably, the dry weight of the light-sensitive layer is from 3 to 6 g per square meter. This layer, notwithstanding its slight thickness, is able to fully absorb 1.5–4.5 $cm^3$ per square meter of developing liquid, so that upon development of the diazotype material according to the process referred to before, copies feeling dry are obtained almost immediately. Preferably, also the reverse side of the diazotype material according to the invention is provided with a sealing layer. Also this layer is preferably applied to the paper support from an aqueous liquid. The composition of this sealing layer may be equal to that of the front layer. However, the reverse layer can also be formed with the aid of other, more or less hydrophobic, film-forming substances, such as for example polyacrylates, polymethacrylates, polyvinyl chloride, copolymers of acrylates with methacrylates, of vinyl chloride with vinyl acetate, of styrene with acrylonitrile and, optionally, butadiene, and of acrylonitrile with butadiene.

A filler can also be incorporated in the reverse layer, e.g. to improve the drafting characteristics of the layer. Besides ordinary opaque paper, the support of the diazotype material according to the invention may be natural transparent paper or transparentized paper. As a sealing layer is applied between the support and the light-sensitive layer, extremely high demands, for example with respect to the degree of sizing and pH of the surface, need not be made upon the support.

The diazotype material according to the invention can, of course, also be developed in the conventional way, whereby the developing liquid is applied onto the light-sensitive side or on either side of the diazotype material, and the amount of liquid applied is 6 $cm^3$ or more per square meter per side.

In addition to the diazonium compound, an azo-coupling component or a mixture of azo-coupling components may be incorporated in the light-sensitive layer of the diazotype material according to the invention. The two-component diazotype material thus obtained can be developed by spreading a small amount of alkaline developing liquid, which need not contain any azo-coupling component now, over the light-sensitive side of the diazotype material. The two-component diazotype material is suitable, e.g., for being developed according to the process described in the United States Patent Specification No. 3,446,620, whereby concentrated amine solution is spread to an amount of approximately 3 $cm^3$ per square meters over the light-sensitive layer. It stands to reason that this two-component diazotype material can also be developed in the conventional way, by the action of ammonia vapour or other alkaline vapours.

EXAMPLE 1

White base paper for the diazotype process of 80 $g/m^2$ was provided on either side with a sealing layer having a dry weight of 4–4.5 g per square meter, using a liquid of the following composition:

60 ml of a 50 percent. aqueous dispersion of polyvinyl acetate
2.5 ml of hexamethoxymethylmelamine
0.2 g of p-toluene sulphonic acid water up to 100 ml.

The layers were dried and cross-linked by heating them at 150°–180° C. for 30 seconds.

One side of the coated support was then provided with a light-sensitive layer, using a liquid of the following composition:

2 g of 4-dimethylamino-3-(4'-chlorophenoxy)-6-chlorobenzene diazonium hydrogen-sulphate
2 g of high-molecular polyvinyl alcohol with a degree of hydrolysis of 98% (Elvanol 72–60 of Du Pont de Nemours and Co., U.S.A.)
20 g of rice starch
15 ml of n-propanol water up to 100 ml.

The light-sensitive layer had a dry weight of approximately 4 $g/m^2$.

The diazotype material thus obtained was exposed under a line original until all the diazonium compound underneath the white areas of the original had been bleached out.

The exposed material was then developed in a developing device as described in the Dutch Patent Application 72 07 099, whereby developing liquid to an amount of approximately 3.5 $cm^3$ per square meter was applied to the light-sensitive side. The developing liquid contained per liter:

29 g of phloroglucinol
89 g of succinic acid, potassium hydroxide to bring the pH of the liquid on 6.0, and water.

A copy with a strong, black image on a clear background was obtained. The copy showed no curl and felt dry to the touch almost immediately.

EXAMPLE 2

Base paper for the diazotype process of 80 $g/m^2$ was provided on either side with a sealing layer having a dry weight of approximately 2 g per square meter, using a liquid of the following composition:

30 ml of a 50 percent. aqueous dispersion of a copolymer of 60% by weight of styrene with 40% by weight of butadiene
70 ml of water.

One side of the support was then coated with a light-sensitive layer having a dry weight of 5 g per square meter, using the sensitizing liquid described in Example 1, with the proviso that it now contained 7.5 ml of n-propanol. The diazotype material obtained was exposed imagewise and developed in the way described in Example 1.

The development of the material proceeded quickly. The copy showed no curl, it immediately felt dry to the touch, and yielded a strong, black image on a clear background.

EXAMPLE 3

Base paper for the diazotype process of 65 $g/m^2$ was provided on either side with a sealing layer having a dry weight of approximately 7 g per square meter, using a liquid of the following composition:

60 ml of a 50 percent. aqueous dispersion of polyvinyl acetate
40 ml of water.

One side of the support was coated with a light-sensitive layer having a dry weight of approximately 4 g per square meter, by means of a liquid containing:

3.2 g of 4-N-methyl-N-cyclohexylamino-3-methoxy-2-N-methyl-N-ethoxycarbonylamino benzene diazoniumchlorozincate
0.6 g of citric acid
3 g of polyvinyl alcohol having a degree of hydrolysis of approximately 77% (Gohsenol KH 17 of Nippon Gohsei, Osaka, Japan)
20 g of rice starch
10 ml of n-propanol water up to 100 ml.

The diazotype material was exposed imagewise and developed in the way described in Example 1. A strong, non-curling copy immediately feeling dry, and showing a black image on a white background was obtained.

EXAMPLE 4

Base paper for the diazotype process of 65 g/m$^2$ was provided on one side with a sealing layer having a dry weight of 5 g per square meter, using a liquid of the following composition:

- 40 ml of a 50 percent. aqueous dispersion of a copolymer of 70% by weight of styrene and 30% by weight of butadiene
- 8 g of amorphous silica with a primary particle size of 30 nanometers
- 60 ml of water.

The reverse side of the paper was then provided with a sealing layer having a dry weight of 4 g per square meter, using a 35 percent. aqueous dispersion of polyvinyl acetate. The front side of the paper was then coated with a light-sensitive layer having a dry weight of 7 g per square meter, using a liquid containing:

- 1.8 g of 4-N-benzoylamino-2-N-methyl-N-ethoxycarbonylamino-5-methoxy-benzene diazonium-chlorozincate
- 0.4 g of citric acid
- 2 g of high-molecular polyvinyl alcohol with a degree of hydrolysis of approximately 98%
- 30 g of wheat starch
- 0.5 g of saponine water up to 100 ml.

The diazotype material was then exposed imagewise and developed in the way described in Example 1. A strong copy with a brown image on a white background was obtained. The development of the material proceeded quickly. The copy did not curl and it immediately felt dry.

EXAMPLE 5

Natural transparent paper of 75 g/m$^2$ was provided on either side with a sealing layer having a dry weight of approximately 2.5 g per square meter, using a liquid of the following composition:

- 50 ml of a 50 percent. aqueous dispersion of a copolymer of 60% by weight of styrene with 40% by weight of butadiene
- 50 ml of ethanol.

One side of the paper thus coated was then provided with a light-sensitive layer having a dry weight of approximately 5 g per square meter, by means of a liquid containing:

- 2.7 g of 4-N-benzoylamino-2-N-methyl-N-ethoxycarbonylamino-5-methoxy-benzene diazoniumhydrogensulphate
- 3 g of high-molecular polyvinyl alcohol with a degree of hydrolysis over 98% (Gohsenol NH26)
- 15 g of rice starch
- 0.5 g of saponine.

The diazotype material was exposed under a line original until the diazonium compound underneath the white areas of the original had just been bleached out and, subsequently, developed in the way described in Example 1.

The development of the material proceeded quickly. The copy did not curl and it immediately felt dry. It showed a strong brown image on a clear background, and could be used as an intermediate original for further copying on diazotype paper.

EXAMPLE 6

White base paper of 65 g/m$^2$ was provided on one side with a sealing layer having a dry weight of approximately 6 g per square meter, using liquid of the following composition:

- 40 ml of a 50 percent. aqueous dispersion of a copolymer of 60% by weight of styrene with 40% by weight of butadiene
- 5 g of clay
- 60 ml of water.

The reverse side of the paper was then provided with a sealing layer having a dry weight of 3 g per square meter, using an aqueous polyvinyl chloride dispersion (Lutofan 300 D of B.A.S.F., Ludwigshafen/Rhein, Germany).

The front side of the paper was then coated with a light-sensitive layer having a dry weight of 4 g per square meters, by means of a liquid containing:

- 2 g of 4-morpholino-2,5-dibutoxy-benzene diazoniumhydrogensulphate
- 2 g of polyvinyl alcohol with a degree of hydrolysis of 98% (Elvanol 72–60)
- 15 g of corn starch
- 10 ml of n-propanol.

The diazotype material thus obtained was exposed imagewise under a line original and then developed in the way described in Example 1, using now a developer of the composition:

- 10.8 g of phloroglucinol
- 13 g of resorcinol
- 60 g of thiourea
- 10 g of sorbitol
- 100 g of potassium tetraborate (5 aq.)
- 3 g of isopropylnaphthalene sulphonic acid
- 1,000 ml of water.

The copy showed a strong image on a clear background. It did not curl and felt dry to the touch almost immediately.

EXAMPLE 7

Base paper for the diazotype process of 90 g/m$^2$ was provided with a sealing layer having a dry weight of approximately 5 g per square meter, by means of a liquid containing:

- 40 ml of an aqueous 50 percent. dispersion of a copolymer of 65% by weight of styrene with 35% by weight of butadiene
- 12 g of silica with a particle size under 10 micrometers
- 60 ml of water.

The reverse side of the paper was then provided with a sealing layer having a dry weight of 3.5 g per square meter, by means of a liquid containing:

- 30 ml of an aqueous 50 percent. dispersion of a copolymer of 65% by weight of styrene with 35% by weight of butadiene
- 7 g of rice starch
- 70 ml of water.

The front side of the paper was then coated with a light-sensitive layer having a dry weight of approximately 3.5 g per square meter, by means of a liquid containing:

- 1 g of 4-N-ethyl-N-(2'-hydroxyethyl)amino-benzene diazonium-chlorozincate
- 3 g of tartaric acid
- 1 g of 2,3-dihydroxynaphthalene-6-sulphonic acid (sodium salt)
- 2 g of high-molecular polyvinyl alcohol with a degree of hydrolysis over 98% (Gohsenol NH26)
- 20 g of rice starch
- 7 ml of n-propanol water up to 100 ml.

The sheet of the diazotype material thus obtained was exposed under a line original and then developed be spreading over the light-sensitive layer of the paper approximately 3 ml per square meters of developing liquid having the following composition:

48 ml of triethanolamine
43.5 ml of diethyleneglycol monomethylether
8.5 ml of oleic acid.

The copy obtained showed a blue image on a clear background.

I claim:

1. Diazotype material consisting essentially of a paper support each side of which is coated with a substantially water-impermeable sealing layer containing a hydrophobic polymeric, film-forming substance and one side of which has a light-sensitive layer coated onto its sealing layer, characterized in that the sealing layer on at least said one side is a substantially water-impermeable layer having a dry weight of 2 to 10 g/m$^2$ and consisting essentially of film-forming binder selected from the group consisting of polyvinyl acetate and a copolymer of styrene with butadiene, with or without finely divided filler in an amount not exceeding 1 part by weight of filler per part of binder, and said light-sensitive layer has a dry weight of at most 8 g per square meter and consists essentially of, in admixture, a light-sensitive diazonium compound, a polyvinyl alcohol having a degree of hydrolysis over 75% and starch particles, the weight ratio of polyvinyl alcohol to starch particles being 1:5–20, said light-sensitive layer after imagewise exposure to light being capable of absorbing substantially completely and being developable into a strong image by between 1.5 and 4.5cm$^3$/m$^2$ of an aqueous solution of an azo coupling component reactive to said diazonium compound, said light-sensitive layer being adherent to the underlying sealing layer, and said material being substantially non-curling, in either dry or moist condition.

2. Diazotype material according to claim 1, each sealing layer having been formed from an aqueous dispersion of the binder.

3. Diazotype material according to claim 1, in which each sealing layer contains said filler in an amount of at most 1 part by weight of filler per part by weight of film-forming binder.

4. Diazotype material according to claim 3, in which the filler is silica having particle sizes under 10 micrometers.

5. Diazotype material according to claim 1, each sealing layer having been formed from an aqueous polyvinyl acetate dispersion containing a cross-linking agent.

6. Diazotype material according to claim 5, in which the cross-linking agent is hexamethoxymethylmelamine.

7. Diazotype material according to claim 1, each sealing layer having been formed from a dispersion containing a copolymer of 50–75% by weight of styrene with 50–25% by weight of butadiene, and a filler, in the weight ratio copolymer to filler of 1:0.25–0.75.

8. Diazotype material according to claim 1, in which the polyvinyl alcohol in the light-sensitive layer possesses a degree of hydrolysis over 98%.

9. Diazotype material according to claim 8, said polyvinyl alcohol being one of which a 4 percent. aqueous solution at 20° C. has a viscosity of at least 25 centipoises.

10. Diazotype material according to claim 1, in which the light-sensitive layer has a dry weight between 3 and 6 g per square meter.

11. Diazotype material according to claim 1, in which the light-sensitive layer also contains an azo-coupling component and an acid stabilizer.

12. Process for making photocopies, in which a diazotype material is imagewise exposed and then developed by spreading over its light-sensitive side 1.5 to 4.5 cm$^3$ per square meter of an aqueous solution of an azo coupling component, characterized in that the diazotype material consists essentially of a paper support each side of which is coated with a substantially water-impermeable sealing layer having a dry weight of 2 to 10 g/m$^2$ and consisting essentially of a film-forming binder selected from the group consisting of polyvinyl acetate and a copolymer of styrene with butadiene, with or without finely divided filler in an amount not exceeding 1 part by weight of filler per part of film-forming binder, and coated upon the sealing layer at one side of said support a light-sensitive layer having a dry weight of at most 8 g per square meter and consists essentially of, in admixture, a light-sensitive diazonium compound, polyvinyl alcohol having a degree of hydrolysis of at least 75% and starch particles, the weight ratio polyvinyl alcohol to starch particles being 1:5–20, and as said solution is being spread absorbing it substantially completely in said light-sensitive layer and thus forming the latter into a strong image, said light-sensitive layer being firmly adherent to the underlying sealing layer, and said material being substantially non-curling, in either dry or moist condition.

13. Diazotype material consisting essentially of a paper support having coated onto each side thereof a substantially water-impermeable sealing layer having a dry weight of 2 to 10 g/m$^2$ and consisting essentially of a polymeric film-forming binder having a finely divided filler dispersed therein at a weight ratio filler to binder of 0.25–0.75:1, said binder consisting essentially of polyvinyl acetate and a cross-linking agent or of a copolymer of 50–75% by weight of styrene with 50–25% by weight of butadiene and said filler consisting essentially of silica having particle sizes of less than 10 microns, the sealing layer at one side of said support having coated thereupon a light-sensitive layer having a dry weight of about 3 to 6 g/m$^2$ and consisting essentially of, in admixture, a light-sensitive diazonium compound, polyvinyl alcohol having a degree of hydrolysis over 98% and of which a 4% aqueous solution at 20° C. has a viscosity of at least 25 centipoises, and starch particles in a weight ratio to the polyvinyl alcohol of 5 to 20:1, said light-sensitive layer after imagewise exposure to light being capable of absorbing substantially completely and being developable into a strong image by between 1.5 and 4.5 cm$^3$/m$^2$ of an aqueous solution of an azo coupling component reactive to said diazonium compound, said light-sensitive layer being adherent to the underlying sealing layer, and said material being substantially non-curling, in either dry or moist condition.

14. Diazotype material consisting essentially of a paper support each side of which is coated with a substantially water-impermeable sealing layer containing a hydrophobic polymeric, film-forming substance and one side of which has a light-sensitive layer coated onto its sealing layer, characterized in that the sealing layer on at least said one side is a substantially water-impermeable layer having a dry weight of 2 to 10 g/m$^2$ and consisting essentially of film-forming binder selected from the group consisting of film-forming binder selected from the group consisting of polyvinyl acetate and a copolymer of styrene with butadiene, with or without finely divided filler in an amount not exceeding 1 part by weight of filler per part of binder, and said light-sensitive layer has a dry weight of at most 8 g per square meter and consists essentially of, in admixture, a diazonium compound, an azo coupling component reactive to said diazonium compound, a polyvinyl alcohol having a degree of hydrolysis over 75% and starch particles, the weight ratio of polyvinyl alcohol to starch particles being 1:5–20, said light-sensitive layer after imagewise exposure to light being capable of absorbing substantially completely and being developable into a strong image by between 1.5 and 4.5 $cm^3/m^2$ of an alkaline aqueous solution, said light-sensitive layer being adherent to the underlying sealing layer, and said material being substantially non-curling, in either dry or moist condition.

* * * * *